US012091952B2

(12) United States Patent
Oehring et al.

(10) Patent No.: US 12,091,952 B2
(45) **Date of Patent: *Sep. 17, 2024**

(54) AUTOMATED FRACTURING SYSTEM AND METHOD

(71) Applicant: U.S. Well Services, LLC, Houston, TX (US)

(72) Inventors: Jared Oehring, Houston, TX (US); Brandon N. Hinderliter, Houston, TX (US); Alexander James Christinzio, Collegeville, PA (US)

(73) Assignee: U.S. Well Services, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/556,409

(22) Filed: Dec. 20, 2021

(65) Prior Publication Data

US 2022/0364447 A1 Nov. 17, 2022

Related U.S. Application Data

(63) Continuation of application No. 16/564,185, filed on Sep. 9, 2019, now Pat. No. 11,203,924, which is a continuation of application No. 16/160,708, filed on Oct. 15, 2018, now Pat. No. 10,408,031.

(60) Provisional application No. 62/572,148, filed on Oct. 13, 2017.

(51) Int. Cl.

| | |
|---|---|
| ***E21B 43/26*** | (2006.01) |
| ***E21B 21/06*** | (2006.01) |
| ***E21B 41/00*** | (2006.01) |

(52) U.S. Cl.
CPC ..... *E21B 43/2607* (2020.05); *E21B 21/062* (2013.01); *E21B 41/00* (2013.01); *E21B 43/26* (2013.01)

(58) Field of Classification Search
CPC ..... E21B 43/2607; E21B 43/26
See application file for complete search history.

(56) References Cited

U.S. PATENT DOCUMENTS

| | | | | |
|---|---|---|---|---|
| 6,007,227 | A * | 12/1999 | Carlson | E21B 43/267 700/265 |
| 8,616,274 | B2 * | 12/2013 | Belcher | H04L 65/762 340/853.3 |
| 10,408,031 | B2 * | 9/2019 | Oehring | E21B 43/2607 |

(Continued)

*Primary Examiner* — Kenneth L Thompson
(74) *Attorney, Agent, or Firm* — Hogan Lovells US LLP

(57) ABSTRACT

An automated hydraulic fracturing system, including a pump system, a blender configured to form the fracturing fluid, a proppant storage and delivery system, a hydration unit configured to mix an additive into a fluid to form the fluid mixture and provide the fluid mixture to the blender, a fluid storage and delivery system, and an additive storage and delivery system, and an automated control system including a plurality of sensing devices and a plurality of control devices integrated into the pump system, the blender system, the proppant storage and delivery system, the fluid storage and delivery system, and the additive storage and delivery system, the automated control system configured to monitor parameters of the automated hydraulic fracturing system via the plurality of sensing devices and transmit control instructions for one or more of the plurality of control devices to control an aspect of the automated hydraulic fracturing system.

19 Claims, 6 Drawing Sheets

(56) References Cited

U.S. PATENT DOCUMENTS

| | | | | |
|---|---|---|---|---|
| 10,641,075 | B2 * | 5/2020 | Lucas | E21B 43/267 |
| 11,203,924 | B2 * | 12/2021 | Oehring | E21B 43/26 |
| 2021/0040829 | A1 * | 2/2021 | Madasu | G06F 18/24147 |

* cited by examiner

AUTOMATED FRACTURING SYSTEM AND METHOD

CROSS REFERENCE TO RELATED APPLICATIONS

This application is a continuation of U.S. patent application Ser. No. 16/564,185 filed Sep. 9, 2019 titled "AUTOMATED FRACTURING SYSTEM AND METHOD," now U.S. Pat. No. 11,203,924 issued Dec. 21, 2021, which is a continuation of U.S. patent application Ser. No. 16/160,708 filed Oct. 15, 2018, titled "AUTOMATED FRACTURING SYSTEM AND METHOD," now U.S. Pat. No. 10,408,031 issued Sep. 10, 2019, which claims priority to and the benefit of U.S. Provisional Application Ser. No. 62/572,148 filed Oct. 13, 2017 titled "AUTOMATED FRACTURING SYSTEM," the full disclosure of which is hereby incorporated herein by reference in its entirety for all purposes.

BACKGROUND

With advancements in technology over the past few decades, the ability to reach unconventional sources of hydrocarbons has tremendously increased. Horizontal drilling and hydraulic fracturing are two such ways that new developments in technology have led to hydrocarbon production from previously unreachable shale formations. Hydraulic fracturing (fracturing) operations typically require powering numerous components in order to recover oil and gas resources from the ground. For example, hydraulic fracturing usually includes pumps that inject fracturing fluid down the wellbore, blenders that mix proppant into the fluid, cranes, wireline units, and many other components that all must perform different functions to carry out fracturing operations.

Conventionally, these components or systems of components are generally independent systems that are individually controlled by operators. Furthermore, in some cases, operators are also responsible for taking measurements, interpreting raw data, making calculations, and the like. Thus, a large amount of operator intervention to diagnose, interpret, respond to, adjust, and otherwise control operating conditions of the various components.

SUMMARY

Applicant recognized the problems noted above herein and conceived and developed embodiments of systems and methods, according to the present disclosure, for assessing flow rates in hydraulic fracturing systems.

In an embodiment, an automated hydraulic fracturing system includes a pump system fluidly coupled to a wellhead to pump a fracturing fluid into the wellhead, wherein the pump is instrumented with a pump sensor and a pump controller. The hydraulic fracturing system further includes a blender system fluidly coupled to the pump, the blender mixing together one or more materials to form the fracturing fluid, wherein the blender is instrumented with a blender sensor and a blender controller, and a source system for providing at least one of the one or more materials to the blender, wherein the source is instrumented with a source sensor and a source controller. The hydraulic fracturing system also includes another component, the component instrumented with at least one of a component sensor and a component controller. At least one of the pump controller, blender controller, the source controller, or the component controller controls a respective aspect of the automated hydraulic fracturing system based at least in part on automated instructions, the automated instructions generated based on measurements received from at least one of the pump sensor, the blender sensor, the source sensor, or the component sensor.

In an embodiment, an automated hydraulic fracturing system includes a pump system fluidly coupled to a wellhead at a wellsite to pump a fracturing fluid into the wellhead, a blender configured to mix together proppant and a fluid mixture to form the fracturing fluid, a proppant storage and delivery system configured to provide the proppant for the blender, a hydration unit configured to mix an additive into a fluid to form the fluid mixture and provide the fluid mixture to the blender, a fluid storage and delivery system configured to provide the fluid for the hydration unit, an additive storage and delivery system configured to provide the additive to the hydration unit, and an automated control system including a plurality of sensing devices and a plurality of control devices integrated into the pump system, the blender system, the proppant storage and delivery system, the fluid storage and delivery system, and the additive storage and delivery system, the automated control system configured to monitor one or more parameters of the automated hydraulic fracturing system via the plurality of sensing devices and transmit control instructions for one or more of the plurality of control devices to control an aspect of the automated hydraulic fracturing system.

In an embodiment, an automated hydraulic fracturing method includes initiating a hydraulic fracturing operation using an automated hydraulic fracturing system, providing a first material for a fracturing fluid from a first source to a blender, the first source including a source sensor for measuring one or more parameters associated with the first source and a source controller for controlling one or more functions of the first source, providing a second material for the fracturing fluid from a second source to the blender, mixing the first material and the second material at the blender to form the fracturing fluid, the blender including a blender sensor for measuring one or more parameters associated with the blender and a blender controller for controlling one or more functions of the bender, providing the fracturing fluid from the blender to a pump, the pump including a pump sensor for measuring one or more parameters associated with the pump and a pump controller for controlling one or more functions of the pump, injecting the fracturing fluid from the pump into a wellhead coupled to a well, monitoring the one or more parameters via the source sensor, the blender sensor, and the pump sensor, generating automated instructions for at least one of the source controller, the blender controller, or the pump controller based at last in part on the one or more parameters, and controlling at least one of the one or more functions of the first source, the blender, or the pump via the source controller, the blender controller, or the pump controller, respectively, based at least in part on the automated instructions.

BRIEF DESCRIPTION OF DRAWINGS

The foregoing aspects, features, and advantage of embodiments of the present disclosure will further be appreciated when considered with reference to the following description of embodiments and accompanying drawings. In describing embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

DETAILED DESCRIPTION

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

When introducing elements of various embodiments of the present disclosure, the articles "a", "an", "the", and "said" are intended to mean that there are one or more of the elements. The terms "comprising", "including", and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments", or "other embodiments" of the present disclosure are not intended to be interpreted as excluding the existence of additional embodiments that also incorporate the recited features. Furthermore, reference to terms such as "above", "below", "upper", "lower", "side", "front", "back", or other terms regarding orientation or direction are made with reference to the illustrated embodiments and are not intended to be limiting or exclude other orientations or directions. Additionally, recitations of steps of a method should be understood as being capable of being performed in any order unless specifically stated otherwise. Furthermore, the steps may be performed in series or in parallel unless specifically stated otherwise.

Figure 1:
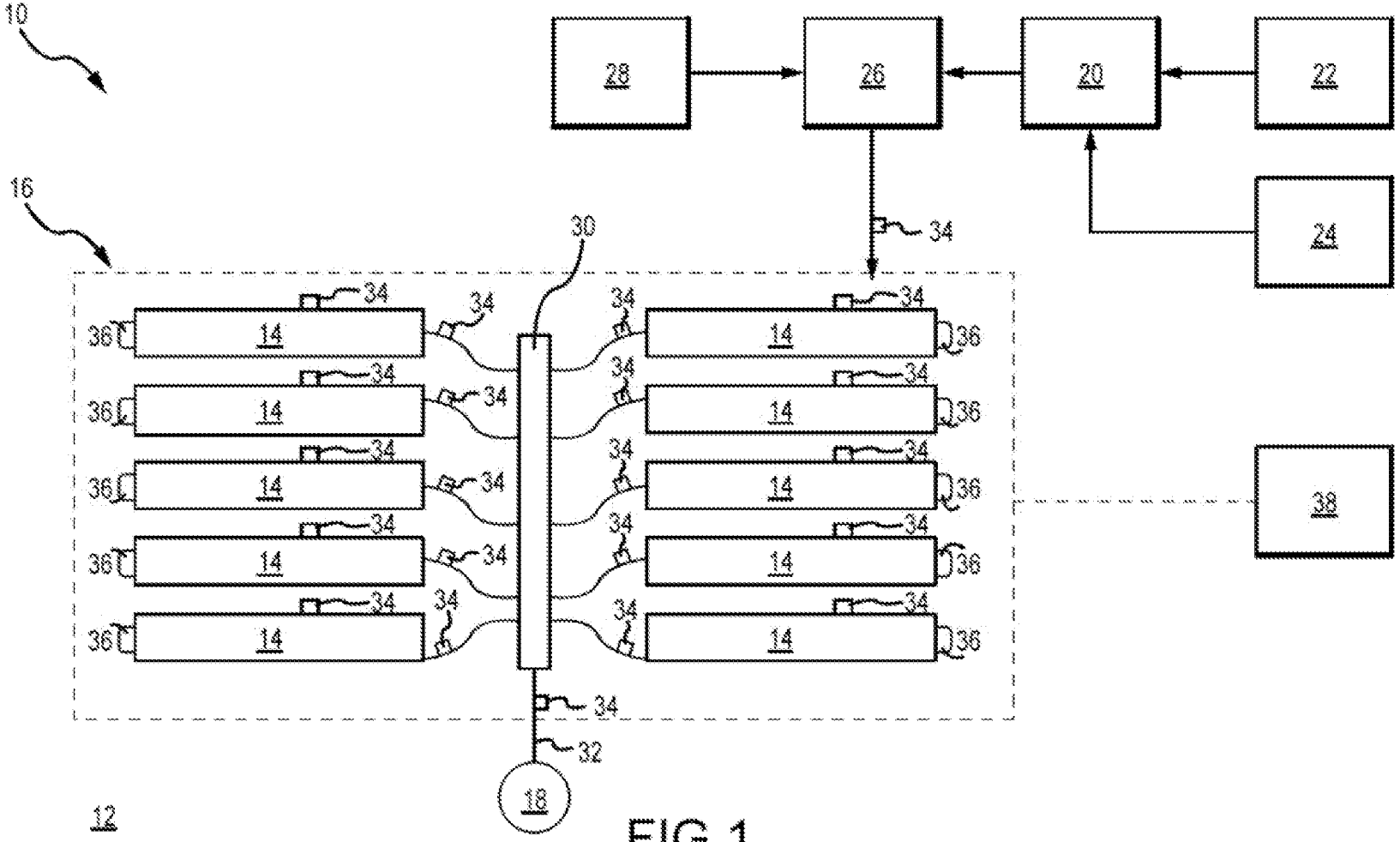
FIG. 1 is a schematic plan view of an embodiment of an automated hydraulic fracturing operation, in accordance with embodiments of the present disclosure.

FIG. 1 is a schematic representation of an embodiment of a hydraulic fracturing system 10 positioned at a well site 12. In the illustrated embodiment, pump trucks 14, which make up a pumping system 16, are used to pressurize a fracturing fluid solution for injection into a wellhead 18. A hydration unit 20 receives fluid from a fluid source 22 via a line, such as a tubular, and also receives additives from an additive source 24. In an embodiment, the fluid is water and the additives are mixed together and transferred to a blender unit 26 where proppant from a proppant source 28 may be added to form the fracturing fluid solution (e.g., fracturing fluid) which is transferred to the pumping system 16. The pump trucks 14 may receive the fracturing fluid solution at a first pressure (e.g., 80 psi to 100 psi) and boost the pressure to around 15,000 psi for injection into the wellhead 18. In certain embodiments, the pump trucks 14 are powered by electric motors.

After being discharged from the pump system 16, a distribution system 30, such as a missile, receives the fracturing fluid solution for injection into the wellhead 18. The distribution system 30 consolidates the fracturing fluid solution from each of the pump trucks 14 (for example, via common manifold for distribution of fluid to the pumps) and includes discharge piping 32 (which may be a series of discharge lines or a single discharge line) coupled to the wellhead 18. In this manner, pressurized solution for hydraulic fracturing may be injected into the wellhead 18. In the illustrated embodiment, one or more sensors 34, 36 are arranged throughout the hydraulic fracturing system 10. In embodiments, the sensors 34 transmit flow data to a data van 38 for collection and analysis, among other things.

Figure 2:
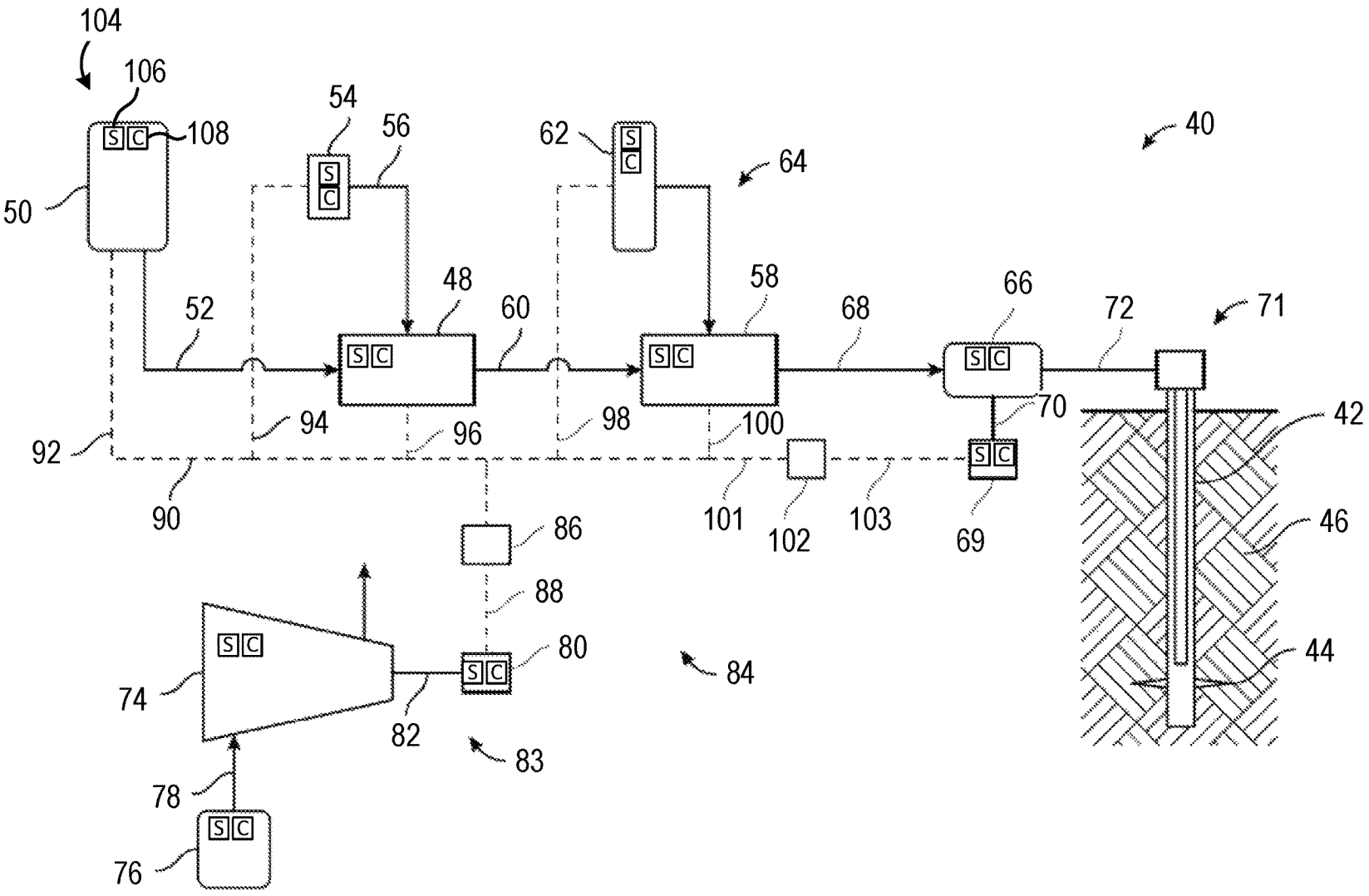
FIG. 2 is a schematic diagram of an embodiment of an automated hydraulic fracturing system, in accordance with embodiments of the present disclosure.

FIG. 2 is a detailed schematic representation of an automated hydraulic fracturing system 40, that can be used for pressurizing a wellbore 42 to create fractures 44 in a subterranean formation 46 that surrounds the wellbore 42. Included with the system 40 is a hydration unit 48 that receives fluid from a fluid source 50 via line 52, and also selectively receives additives from an additive source 54 via line 56. Additive source 54 can be separate from the hydration unit 48 as a stand-alone unit, or can be included as part of the same unit as the hydration unit 48. The fluid, which in one example is water, is mixed inside of the hydration unit 48 with the additives. In an embodiment, the fluid and additives are mixed over a period of time, to allow for uniform distribution of the additives within the fluid. In the example of FIG. 2, the fluid and additive mixture is transferred to a blender unit 58 via line 60. A proppant source 62 contains proppant, which is delivered to the blender unit 58 as represented by line 64, where line 64 can be a conveyer. Inside the blender unit 58, the proppant and fluid/additive mixture are combined to form a fracturing fluid, which is then transferred to a fracturing pump system 66 via line 68; thus fluid in line 68 includes the discharge of blender unit 58 which is the suction (or boost) for the fracturing pump system 66.

Blender unit 58 can have an onboard chemical additive system, such as with chemical pumps and augers. Optionally, additive source 54 can provide chemicals to blender unit 58; or a separate and standalone chemical additive system (not shown) can be provided for delivering chemicals to the blender unit 58. In an example, the pressure of the fracturing fluid in line 68 ranges from around 80 psi to around 100 psi. The pressure of the fracturing fluid can be increased up to around 15,000 psi by pump system 66. A motor 69, which connects to pump system 66 via connection 40, drives pump system 66 so that it can pressurize the fracturing fluid. In one example, the motor 69 is controlled by a variable frequency drive ("VFD").

After being discharged from pump system 66, fracturing fluid is pumped into a wellhead assembly 71. Discharge piping 42 connects discharge of pump system 66 with wellhead assembly 71 and provides a conduit for the fracturing fluid between the pump system 66 and the wellhead assembly 71. In an alternative, hoses or other connections can be used to provide a conduit for the fracturing fluid between the pump system 66 and the wellhead assembly 71. Optionally, any type of fluid can be pressurized by the fracturing pump system 66 to form injection fracturing fluid that is then pumped into the wellbore 42 for fracturing the formation 44, and is not limited to fluids having chemicals or proppant.

An example of a turbine 74 is provided in the example of FIG. 1. The turbine 74 can be gas powered, receiving a combustible fuel from a fuel source 76 via a feed line 78. In one example, the combustible fuel is natural gas, and the fuel source 76 can be a container of natural gas or a well (not shown) proximate the turbine 74. Combustion of the fuel in the turbine 74 in turn powers a generator 80 that produces electricity. Shaft 82 connects generator 80 to turbine 74. The combination of the turbine 74, generator 80, and shaft 82 define a turbine generator 83. In another example, gearing can also be used to connect the turbine 74 and generator 80.

An example of a micro-grid 84 is further illustrated in FIG. 2, and which distributes electricity generated by the turbine generator 83. Included with the micro-grid 84 is a transformer 86 for stepping down voltage of the electricity generated by the generator 80 to a voltage more compatible for use by electrically powered devices in the hydraulic fracturing system 40. In another example, the power generated by the turbine generator and the power utilized by the electrically powered devices in the hydraulic fracturing system 10 are of the same voltage, such as 4160 V, so that main power transformers are not needed. In one embodiment, multiple 3500 kVA dry cast coil transformers are utilized. Electricity generated in generator 80 is conveyed to transformer 86 via line 88. In one example, transformer 86 steps the voltage down from 13.8 kV to around 600 V. Other step down voltages can include 4,160 V, 480 V, or other voltages.

The output or low voltage side of the transformer 56 connects to a power bus 90, lines 92, 94, 96, 98, 100, and 101 connect to power bus 90 and deliver electricity to electrically powered components of the system 40. More specifically, line 92 connects fluid source 20 to bus 90, line 94 connects additive source 24 to bus 90, line 96 connects hydration unit 18 to bus 90, line 98 connects proppant source 62 to bus 90, line 100 connects blender unit 28 to bus 90, and line 101 connects bus 90 to an optional variable frequency drive ("VFD") 102. Line 103 connects VFD 102 to motor 69. In one example, VFD 102 can be used to control operation of motor 69, and thus also operation of pump 66.

In an example, additive source 54 contains ten or more chemical pumps for supplementing the existing chemical pumps on the hydration unit 48 and blender unit 58. Chemicals from the additive source 54 can be delivered via lines 56 to either the hydration unit 48 and/or the blender unit 58. In one embodiment, the elements of the system 40 are mobile and can be readily transported to a wellsite adjacent the wellbore 42, such as on trailers or other platforms equipped with wheels or tracks.

In the illustrated embodiment, one or more instrumentation devices 104 such as various types of sensors 106 and controllers 108 are arranged throughout the hydraulic fracturing system 40 and coupled to one or more of the aforementioned components, including any of the wellhead assembly 71, pump 66, blender unit 58, proppant source 62, hydration unit 48, additive source 54, fluid source 50, generator 80, turbine 74, fuel source 76, any deliveries lines, and various other equipment used in the hydraulic fracturing system 40, not all of which are explicitly described herein for sake of brevity. The instrumentation 104 may include various sensors, actuators, and/or controllers, which may be different for different components. For example, the instrumentation devices 104 may include hardware features such as, low pressure transducer (low and high frequency), high pressure transducers (low and high frequency), low frequency accelerometers, high frequency accelerometers, temperature sensors, external mounted flow meters such as doppler and sonar sensors, magnetic flow meters, turbine flow meters, proximity probes and sensors, speed sensors, tachometers, capacitive, doppler, inductive, optical, radar, ultrasonic, fiber optic, and hall effect sensors, transmitters and receivers, stroke counters, GPS location monitoring, fuel consumption, load cells, PLCs, and timers. In some embodiments, the instrumentation devices may be installed on the components and dispersed in various locations.

The components may also include communication means that enable all the sensor packages, actuation devices, and equipment components to communicate with each other allowing for real time conditional monitoring. This would allow equipment to adjust rates, pressure, operating conditions such as engine, transmission, power ends RPMs, sand storage compartment gates, valves, and actuators, sand delivery belts and shoots, water storage compartments gates, valves, and actuators, water delivery lines and hoses, individual fracture pump's rates as well as collective system rates, blender hydraulics such as chemical pumps, liquid and dry, fan motors for cooling packages, blender discharge pumps, electric and variable frequency powered chemical pumps and auger screws, suction and discharge manifold meters, valves, and actuators. Equipment can prevent failures, reduce continual damage, and control when it is allowed and not allowed to continue to operate based on live and continuous data readings. Each component may be able to provide troubleshooting codes and alerts that more specifically narrow down the potential causes of issues. This allows technicians to more effectively service equipment, or for troubleshooting or other processes to be initialized automatically. Conditional monitoring will identify changes in system components and will be able to direct, divert, and manage all components so that each is performing its job the most efficiently In some embodiments, the sensors may transmit data to a data van 38 for collection and analysis, among other things. In some embodiment, the sensors may transmit data to other components, to the central processing unit, or to devices and control units remote from the site. The communications between components, sensors, and control devices may be wired, wireless, or a combination of both. Communication means may include fiber optics, electrical cables, WiFi, Bluetooth, radio frequency, and other cellular, nearfield, Internet-based, or other networked communication means.

The features of the present disclosure may allow for remote monitoring and control from diverse location, not solely the data van 68. Fracturing control may be integrated in with the sensor and monitoring packages 104 to allow for automated action to be taken when/if needed. Equipment may be able to determine issues or failures on its own, then relay that message with a specified code and alarm. Equipment may also be in control to shut itself down to prevent failures from occurring. Equipment may monitor itself as well as communicate with the system as a whole. This may allow whole system to control equipment and processes so that each and every component is running at its highest efficiency, sand, water, chemical, blenders, pumps, and low and high pressure flow lines. Features of the present disclosure may capture, display, and store data, which may be visible locally and remotely. The data may be accessible live during the data collection and historical data may also be available. Each component to this system can be tested individually with simulation as well as physical function testing.

Operating efficiencies for each individual component and the system 40 may be greatly improved. For example, sand storage and delivery to the blender can be monitored with load cells, sonar sensors and tachometers to determine storage amounts, hopper levels, auger delivery to the tub. Pump efficiencies may be monitored with flow sensors, accelerometers, pressure transducer and tachometers to optimize boost and rate while minimizing harmful conditions such as cavitation or over rating. Failure modes such as wash outs, cutting, valve and/or seat failures, packing issues and supply blockage can be captured and then prevented. Flow lines, both suction supply and discharge can be monitored with flow meters to distribute and optimize flow rates and velocities while preventing over pumping scenarios. Feedback loops of readings from blender to supply manifolds and to pumps can work with each other to optimize pressure and flow. Dropping out of an individual pump may occur preventing further failures, when this occurs the system as a whole may automatically select the best pumps to make up that needed rate. These changes and abilities solve equipment issues and prevent down time as well as provide a means to deliver a consistent job.

In some embodiments, instrumentation devices 104 (any of the above described, among others) can be imbedded, mounted, located in various locations such as in line with flow vessels like hoses, piping, manifolds, placed one pump components such as fluid ends, power ends, transmission, engines, and any component within these individual pieces, mounted external to piping and flow vessels, mounted on under or above sand and water storage containers. Blender hoppers could be duel equipped with hopper proximity level sensors as well as a load cell to determine amount of sand in the hopper at any given time.

Figure 3:
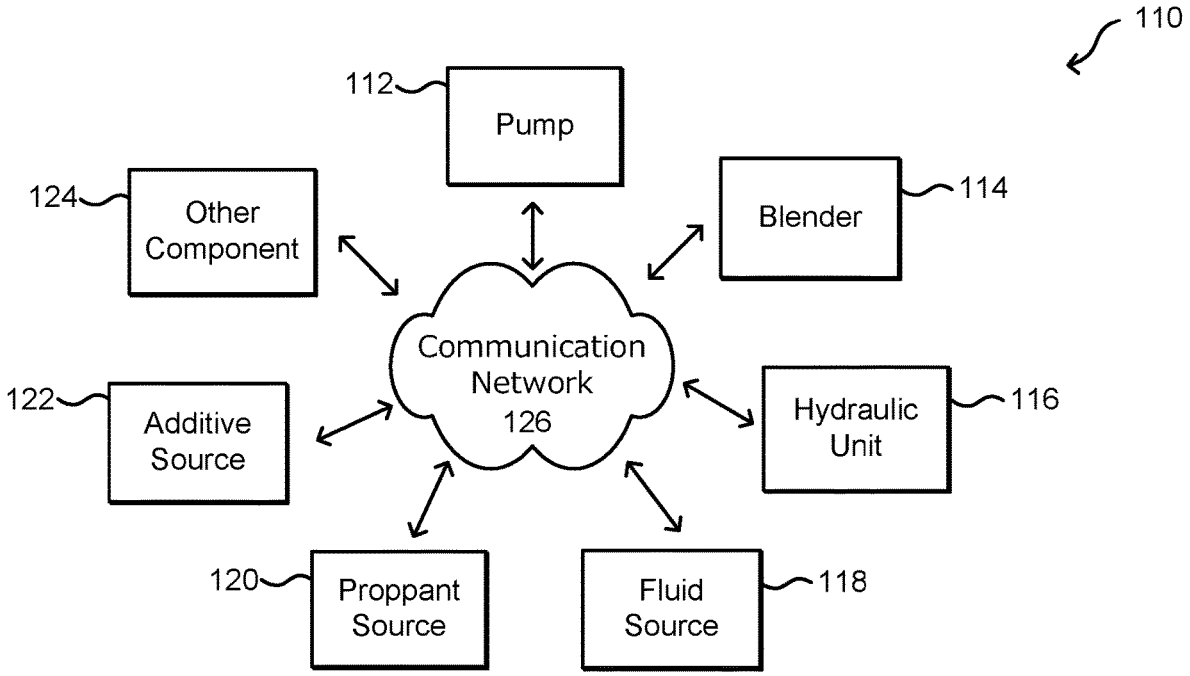
FIG. 3 is a diagram of communicative components of an automated hydraulic fracturing system, in accordance with embodiments of the present disclosure.

FIG. 3 includes a diagram 110 illustrating a connected automated fracturing system, in accordance with various embodiments. In this example, one or more components 42 of a fracturing system, such as a pump 112, blender 114, hydration unit 116, fluid source 118, proppant source 120, additive source 122, and one or more other components 124, may include communication devices for transmitting and receiving data with each other over a communication network 126. In some embodiments, at least some of the components include processors that analyze the data received from one or more of the other components and automatically controls one or more aspects of that component. The communication network 110 may include various types of wired or wireless communication protocols, or a combination of wired and wireless communications. In some embodiments, the connected automated fracturing system further includes one or more of a plurality of components including a manifold, a manifold trailer, a discharge piping, flow lines, conveyance devices, a turbine, a motor, a variable frequency drive, a generator, or a fuel source. Sensors and control devices may be integrated into the one or more of these components, allowing these components to communicate with the rest of the system.

Figure 4:
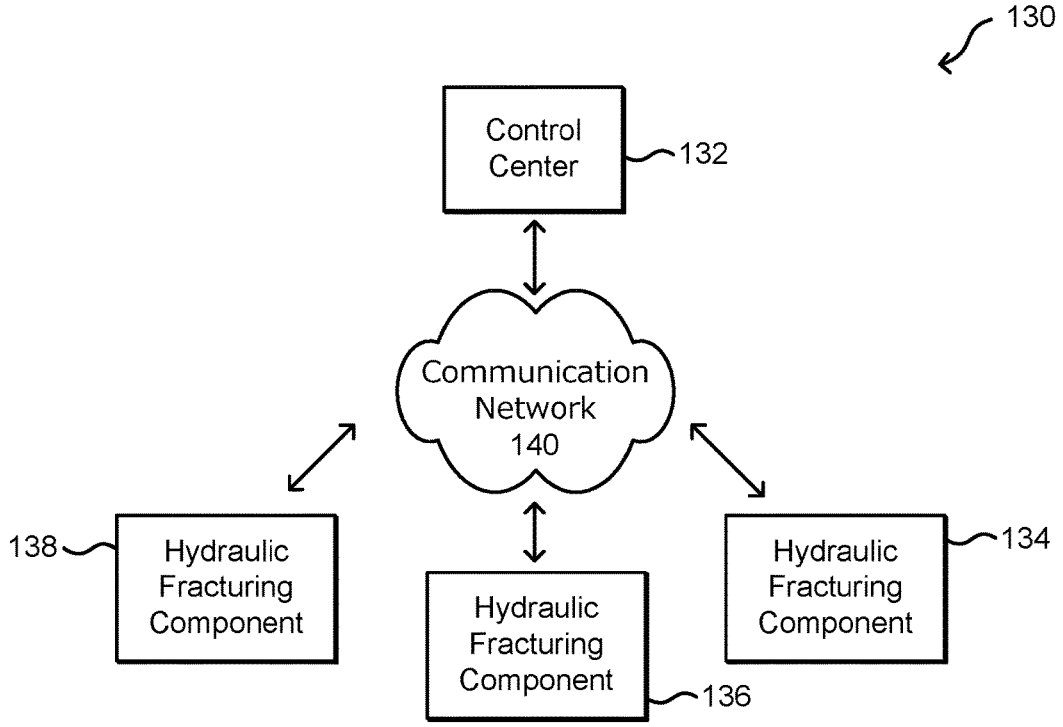
FIG. 4 is a diagram of communicative components of an automated hydraulic fracturing system with a central control center, in accordance with embodiments of the present disclosure.

FIG. 4 includes a diagram 130 illustrating a communications network of the automated fracturing system, in accordance with various embodiments. In this example, one or more hydraulic fracturing components 138, such as, and not limited to, any of those mentioned above, may be communicative with each other via a communication network 140 such as described above with respect to FIG. 3. The components 138 may also be communicative with a control center 132 over the communication network 140. The control center 132 may be instrumented into the hydraulic fracturing system or a component. The control center 132 may be onsite, in a data van, or located remotely. The control center 132 may receive data from any of the components 138, analyze the received data, and generate control instructions for one or more of the components based at least in part on the data. For example, the control center 132 may control an aspect of one component based on a condition of another component. In some embodiments, the control center 140 may also include a user interface, including a display for displaying data and conditions of the hydraulic fracturing system. The user interface may also enable an operator to input control instructions for the components 134. The control center 140 may also transmit data to other locations and generate alerts and notification at the control center 140 or to be received at user device remote from the control center 140.

Figure 5:
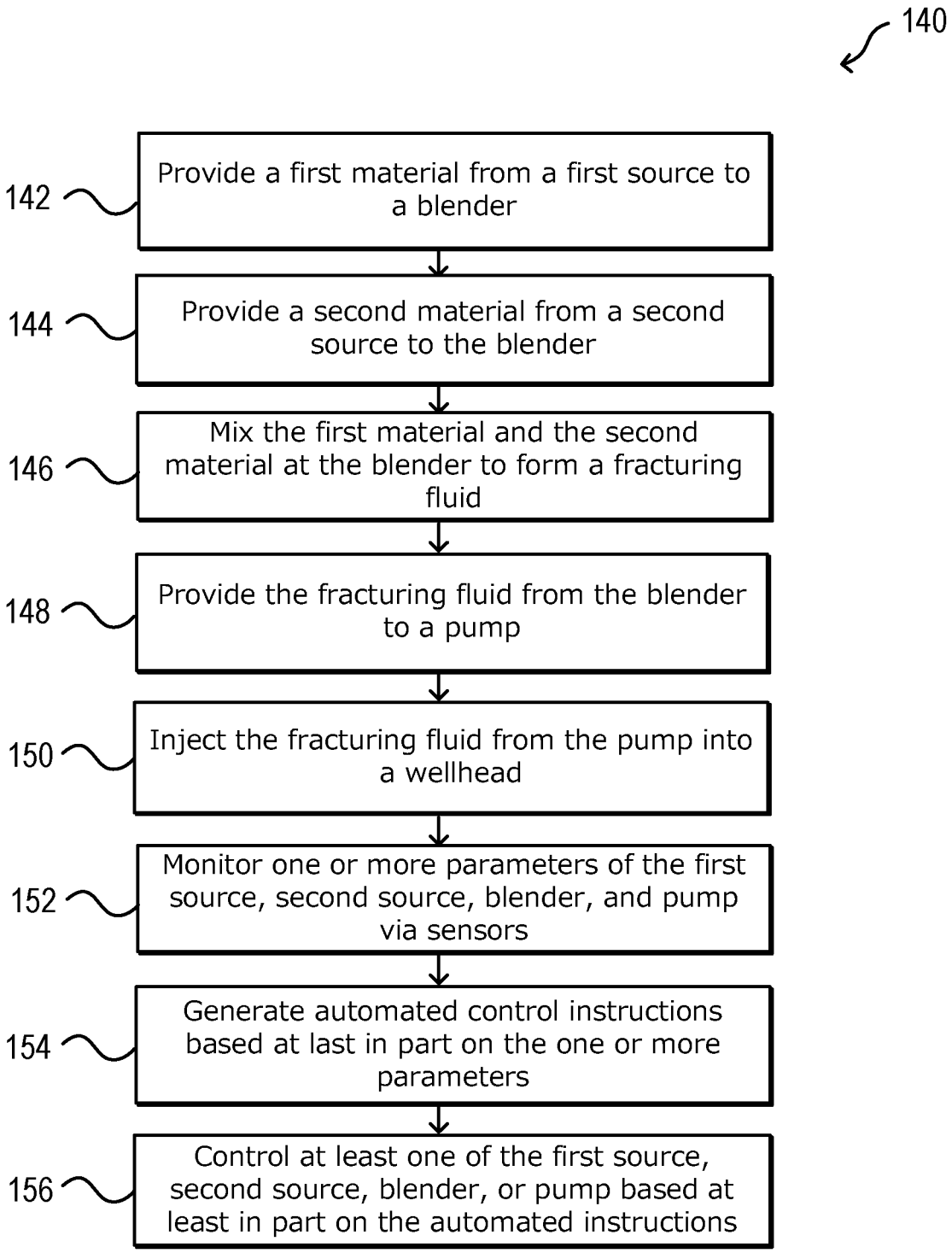
FIG. 5 is a flow chart of an embodiment of an automated hydraulic fracturing method, in accordance with embodiments of the present disclosure.

FIG. 5 is a flow chart of an embodiment of an automated hydraulic fracturing method 140, in accordance with example embodiments. It should be noted that the method may include additional steps, fewer steps, and differently ordered steps than illustrated in this example. In this example, a hydraulic fracturing operation is initiated 142 using an automated hydraulic fracturing system. A first material for a fracturing fluid is provided 144 from a first source to a blender. The first source includes a sensor for measuring one or more parameters associated with the first source and a controller for controlling one or more functions of the first source. A second material for the fracturing fluid is provided from a second source to the blender. The second source may also be instrumented with a sensor and a controller. The first material and the second material is mixed 146 at the blender to form the fracturing fluid. The blender may also be include a sensor for measuring one or more parameters associated with the blender and a controller for controlling one or more functions of the bender. The fracturing fluid is provided from the blender to a pump, and the pump includes a sensor for measuring one or more parameters associated with the pump and a controller for controlling one or more functions of the pump. The fracturing fluid is then injected 150 from the pump into a wellhead coupled to a well. The one or more parameters are monitored 152 via the sensors on the first source, second source, blender, pump, and various other sensors in the hydraulic fracturing system. Automated instructions can then be generated 154 for at least one of the source controller, the blender controller, or the pump controller based at last in part on the one or more parameters.

At least one of the one or more functions of the first source, the blender, the pump, or other component of the hydraulic fracturing system may be controlled 156 via the respective controller based on the automated control instructions. In some embodiments, the instructions may cause one or more of the control devices to automatically adjust one or more of a flow rate, a pressure, power, motor speed, gates, valve, actuators, delivery lines and conveyance devices, pump rates, or cooling systems. For example, a pump system may include comprises a motor controlled by the pump controller based at least in part on the automated instructions. In some embodiments, the blender includes at least one of a chemical pump, a cooling system, an auger, a blender discharge pump, a valve, or an actuator, any of which may be controlled by the blender controller based at least in part on the automated instructions. In some embodiments, the first or second source may include at least one of a gate, a valve, an actuator, a delivery belt, a delivery line, or a chemical pump, any one of which may controlled by a source controller based at least in part on the automated instructions. For example, the rate of delivery of a material may be automatically started, stopped, or adjusted based on the automated instructions. The pressure or rate at which the fracturing fluid is injected into the wellhead may be controlled based on the automated instructions.

The hydraulic fracturing system may include other components, such as a turbine, a generator, a hydration unit, a distribution system, a fuel source, or a wellhead, among others. These components may also be instrumented with sensors that measures at least one parameter associated with the turbine, the generator, the hydration unit, the distribution system, the fuel source, or the wellhead. These components may also include controllers, which control at least one aspect of the turbine, the generator, the hydration unit, the distribution system, the fuel source, or the wellhead, based at least in part on the automated instructions. In some embodiments, the hydraulic fracturing system includes a plurality of pumps and a distribution system, in which fracturing fluid is provided from the blender to the plurality of pumps, the fracturing fluid is provided from the plurality of pumps to the distribution system, and the fracturing fluid is injected from the distribution system into the wellbore. The individual pressure at each pump may be automatically adjusted based on the automated instructions. The combined or overall pump rate of the plurality of pumps may also be controlled, and the rate at the distribution system may also be controlled via the automated instructions.

In some embodiments, the method 140 may include detecting that at least one of the one or more parameters is outside of an acceptable threshold and automatically stopping or adjusting one or more functions of the hydraulic fracturing system in response to the detection. In some embodiments, the method 140 may include detecting substandard performance in one or more areas of the automated hydraulic fracturing system, automatically troubleshooting the automated hydraulic fracturing system based on live data from a plurality of sensors or previous data collected by the sensors, determining one or more causes or suspected causes of the substandard performance, and automatically adjusting one or more components of the automated hydraulic fracturing system to resolve the substandard performance. In some embodiments, the system may provide troubleshooting codes or alerts indicative of one or more sources of a performance issue.

Figure 6:
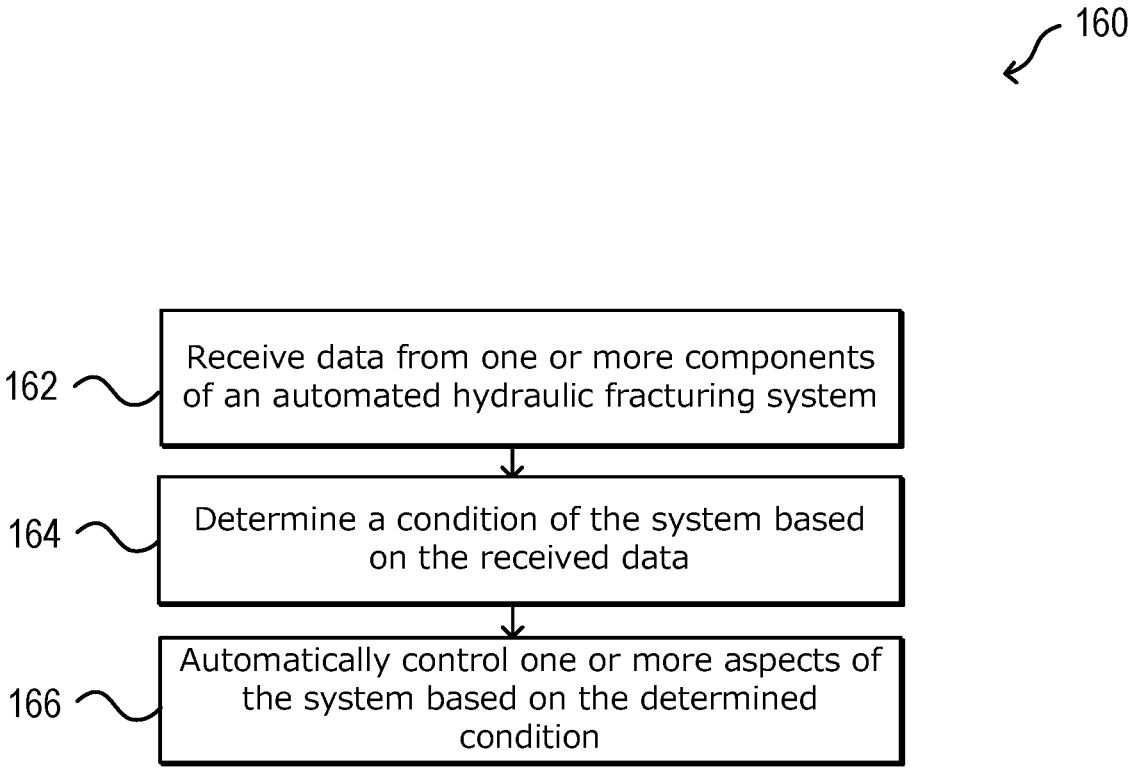
FIG. 6 is a flow chart of an embodiment of a method of controlling an automated hydraulic fracturing system, in accordance with embodiments of the present disclosure.

FIG. 6 illustrates a method 160 of controlling an automated fracturing system, in accordance with various embodiments. In this embodiment, the method 160 includes receiving 162 data from one or more components of an automated fracturing system, such as those described above. The method 160 further includes determining 164 a condition of the system based on the received data. The method further includes controlling 166 one or more aspects of the system based on the determined condition.

Figure 7:
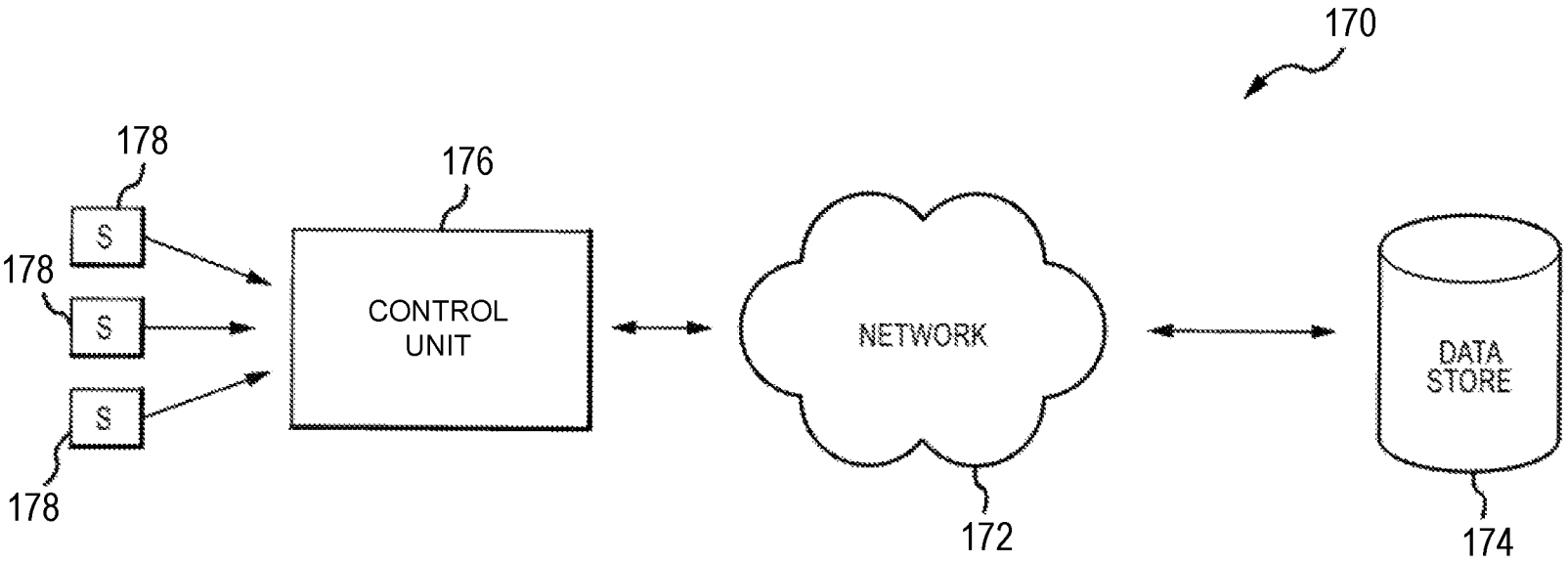
FIG. 7 is a block diagram of an embodiment of a control system of an automated hydraulic fracturing system, in accordance with embodiments of the present disclosure.

FIG. 7 is a block diagram of an embodiment of a control system 170 for receiving, analyzing, and storing information from the well site. As described above, sensors 178 are arranged at the well site and may transmit data to a control unit 176 for evaluation and potential adjustments to operating parameters of equipment at the well site. The control unit 176 may be communicatively coupled to a network 172, such as the Internet, that can access a data store 174, such as a cloud storage server. Accordingly, in embodiments, data from the sensors 178 is transmitted to the control unit 176 (which may be located on a component, within a data van, or remotely) and is stored locally. However, the control unit 176 may upload the data from the sensors 178 along with other data, to the data store 174 via the network 172. Accordingly, data from previous pumping operations or different sensors may be utilized to adjust various aspects of the hydraulic fracturing operation as needed. For example, the flow data from the sensor 178 may be coupled with information from the sensors 178 (such as the vibration sensor, gear sensors, RPM sensors, pressure sensors, etc.) to provide diagnostics with information from the data store 174. For example, previous data may be used as training data for a machine learning model for predicting various control parameters of a present operation. In embodiments, the data store 174 includes information of the equipment used at the well site. It should be appreciated that, in various embodiments, information from the data store 174 may be stored in local storage, for example in storage within a data can, and as a result, communication over the network 172 to the remote data store 174 may not be used. For example, in various embodiments, drilling operations may be conducted at remote locations where Internet data transmission may be slow or unreliable. As a result, information from the data store 174 may be downloaded and stored locally at the data van before the operation, thereby providing access to the information for evaluation of operation conditions at the well site.

The foregoing disclosure and description of the disclosed embodiments is illustrative and explanatory of the embodiments of the invention. Various changes in the details of the illustrated embodiments can be made within the scope of the appended claims without departing from the true spirit of the disclosure. The embodiments of the present disclosure should only be limited by the following claims and their legal equivalents.

The invention claimed is:

1. An automated hydraulic fracturing system, comprising:

a pump system fluidly coupled to a wellhead at a wellsite to pump a fracturing fluid into the wellhead;

a blender configured to mix together proppant and a fluid mixture to form the fracturing fluid;

a proppant storage and delivery system configured to provide the proppant for the blender;

a hydration unit configured to mix an additive into a fluid to form the fluid mixture and provide the fluid mixture to the blender;

a fluid storage and delivery system configured to provide the fluid for the hydration unit;

an additive storage and delivery system configured to provide the additive to the hydration unit; and a plurality of sensing devices integrated into the pump system, the blender system, the proppant storage and delivery system, the fluid storage and delivery system, and the additive storage and delivery system, the plurality of sensing devices configured to monitor one or more parameters of the pump system, the blender system, the proppant storage and delivery system, the fluid storage and delivery system, and the additive storage and delivery system.

2. The system of claim 1, further comprising a plurality of control devices configured to control one or more functions of the pump system, the blender system, the proppant storage and delivery system, the fluid storage and delivery system, and the additive storage and delivery system according to automated instructions generated based on the one or more parameters.

3. The system of claim 2, wherein the control instructions cause the one or more of the plurality of control devices to automatically adjust one or more of a flow rate, a pressure, power, motor speed, gates, valve, actuators, delivery lines and conveyance devices, pump rates, or cooling systems.

4. The system of claim 2, wherein the automated control system comprises processing devices located at the wellsite, remote from the wellsite, or both.

5. The system of claim 1, further comprising a central processing system configured to receive the one or more parameters from the plurality of sensing devices, and generate automated instructions based on the one or more parameters.

6. An automated hydraulic fracturing system, comprising:

a pump system fluidly coupled to a wellhead to pump a fracturing fluid into the wellhead, wherein the pump is instrumented with a pump sensor;

a blender system fluidly coupled to the pump, the blender mixing together one or more materials to form the fracturing fluid, wherein the blender is instrumented with a blender sensor;

a proppant storage and delivery system configured to provide proppant for the blender, wherein the proppant storage and delivery system is instrumented with a proppant sensor;

a hydration unit configured to mix an additive into a fluid to form the fluid mixture and provide the fluid mixture to the blender, wherein the hydration unit is instrumented with a hydration sensor;

a fluid storage and delivery system configured to provide the fluid for the hydration unit, wherein the fluid storage and delivery system is instrumented with a fluid sensor;

an additive storage and delivery system configured to provide the additive to the hydration unit, wherein the additive storage and delivery system is instrumented with an additive sensor; and an automated control system comprising the pump sensor, the blender sensor, the proppant sensor, the hydration sensor, the fluid sensor, and the additive sensor, the automated control system configured to monitor one or more parameters of the automated hydraulic fracturing system via one or more of the sensors.

7. The system of claim 6, wherein:

the pump system further includes a pump controller;

the blender system further includes a blender controller;

the proppant storage and delivery system further includes a proppant controller;

the hydration unit further includes a hydration controller;

the fluid storage and delivery system further includes a fluid controller;

the additive storage and delivery system further includes an additive controller; and the automated control system includes the pump controller, the blender controller, the proppant controller, the hydration controller, the fluid controller, and the additive controller, the automated control system configured to transmit control instructions for one or more of the controllers to control one or more aspects of the automated hydraulic fracturing system.

8. The system of claim 7, wherein the blender comprises at least one of a chemical pump, a cooling system, an auger, a blender discharge pump, a valve, or an actuator, the at least one controlled by the blender controller based at least in part on the automated instructions.

9. The system of claim 7, further comprising:

a component, the component instrumented with at least one of a component sensor and a component controller, wherein the component comprises at least one of a turbine, a generator, a distribution system, a fuel source, or a wellhead.

10. The system of claim 9, wherein the component sensor measures at least one parameter associated with the turbine, the generator, the hydration unit, the distribution system, the fuel source, or the wellhead, and the component controller controls at least one aspect of the turbine, the generator, the distribution system, the fuel source, or the wellhead, based at least in part on the automated instructions.

11. The system of claim 7, further comprising a central processing system configured to receive the measurements from the pump sensor, the blender sensor, the proppant sensor, the hydration sensor, the fluid sensor, and the additive sensor, and generate the automated instructions based on the measurements.

12. The system of claim 11, wherein the central processing system is configured to generate alerts or notifications based on the measurements, the alerts or notifications indicating a condition of a certain component or operation.

13. An automated hydraulic fracturing system, comprising:

a pump system fluidly coupled to a wellhead at a wellsite to pump a fracturing fluid into the wellhead, the pump system comprising a first sensing device configured to measure one or more parameters of the pump system;

a blender configured to mix together proppant and a fluid mixture to form the fracturing fluid, the blender comprising a second sensing device configured to measure one or more parameters of the blender;

a proppant storage and delivery system configured to provide the proppant for the blender, the proppant storage and delivery system comprising a third sensing device configured to measure one or more parameters of the proppant storage and delivery system;

a hydration unit configured to mix an additive into a fluid to form the fluid mixture and provide the fluid mixture to the blender, the hydration unit comprising a fourth sensing device configured to measure one or more parameters of the hydration unit;

a fluid storage and delivery system configured to provide the fluid for the hydration unit, the fluid storage and delivery system comprising a fifth sensing device configured to measure one or more parameters of the fluid storage and delivery system; and an additive storage and delivery system configured to provide the additive to the hydration unit, the additive storage and delivery system comprising a sixth sensing device configured to measure one or more parameters of the additive storage and delivery system.

14. The system of claim 13, wherein:

the pump system includes a first control device configured to control one or more aspects of the pump system based on automated instructions received at the first control device;

the blender includes a second control device configured to control one or more aspects of the blender based on automated instructions received at the second control device;

the proppant storage and delivery system includes a third control device configured to control one or more aspects of the proppant storage and delivery system based on automated instructions received at the third control device;

the hydration unit includes and a fourth control device configured to control one or more aspects of the hydration unit based on automated instructions received at the fourth control device;

the fluid storage and delivery system includes a fifth control device configured to control one or more aspects of the fluid storage and delivery system based on automated instructions received at the fifth control device; and the additive storage and delivery system includes a sixth control device configured to control one or more aspects of the additive storage and delivery system based on automated instructions received at the sixth control device.

15. The system of claim 14, wherein the automated instructions received at the first control device are generated based on the one or more parameters measured by the first sensor, second sensor, third sensor, fourth sensor, fifth sensor, or sixth sensor.

16. The system of claim 14, further comprising a central processing system configured to receive the one or more parameters measured by the first sensor, second sensor, third sensor, fourth sensor, fifth sensor, or sixth sensor, and generate the automated instructions received at the first control device, second control device, third control device, fourth control device, fifth control device, or sixth control device.

17. The system of claim 14, wherein the pump system comprises a motor controlled by the first control device based at least in part on the automated instructions received at the first control device.

18. The system of claim 14, wherein the blender comprises at least one of a chemical pump, a cooling system, an auger, a blender discharge pump, a valve, or an actuator, the at least one controlled by the second control device based at least in part on the automated instructions received at the second control device.

19. The system of claim 14, wherein the automated instructions cause the one or more of first, second, third, fourth, fifth, or sixth control devices to automatically adjust one or more of a flow rate, a pressure, power, motor speed, gates, valve, actuators, delivery lines and conveyance devices, pump rates, or cooling systems.

* * * * *